US009038325B1

(12) United States Patent
Callahan

(10) Patent No.: US 9,038,325 B1
(45) Date of Patent: May 26, 2015

(54) STRUCTURAL SUPPORT DEVICE

(71) Applicant: Janet M. Callahan, West Brookfield, MA (US)

(72) Inventor: Janet M. Callahan, West Brookfield, MA (US)

( * ) Notice: Subject to any disclaimer, the term of this patent is extended or adjusted under 35 U.S.C. 154(b) by 274 days.

(21) Appl. No.: 13/628,113

(22) Filed: Sep. 27, 2012

Related U.S. Application Data

(60) Provisional application No. 61/539,534, filed on Sep. 27, 2011.

(51) Int. Cl.
*E04B 1/34* (2006.01)
*E04F 15/024* (2006.01)
*E04B 1/343* (2006.01)

(52) U.S. Cl.
CPC ..... *E04F 15/02452* (2013.01); *E04B 1/34336* (2013.01)

(58) Field of Classification Search
CPC ..... E04F 15/02452
USPC ..... 52/7, 126.6, 143, 169.9, 170, 263, 299; 248/188, 188.1, 188.2
See application file for complete search history.

(56) References Cited

U.S. PATENT DOCUMENTS 2,086,009 A * 7/1937 Walker ..... 52/292
3,905,548 A * 9/1975 Brodie ..... 237/69
4,899,497 A * 2/1990 Madl, Jr. ..... 52/126.6
5,013,190 A * 5/1991 Green ..... 405/230
5,477,649 A * 12/1995 Bessert ..... 52/263
5,800,094 A * 9/1998 Jones ..... 405/230
5,848,507 A * 12/1998 Bozich ..... 52/299
5,870,866 A * 2/1999 Herndon ..... 52/169.12
6,079,905 A * 6/2000 Ruiz et al. ..... 405/230
6,142,710 A * 11/2000 Holland et al. ..... 405/230
6,193,442 B1 * 2/2001 May ..... 405/232
6,305,134 B1 * 10/2001 Robinson ..... 52/299
6,539,685 B2 * 4/2003 Bell et al. ..... 52/741.15
6,634,150 B1 * 10/2003 Oliver et al. ..... 52/292
6,672,017 B2 * 1/2004 Larson ..... 52/170
7,195,426 B2 * 3/2007 May ..... 405/230
7,228,661 B2 * 6/2007 Rizzotto ..... 52/170
8,112,947 B2 * 2/2012 Mead ..... 52/126.4

* cited by examiner

*Primary Examiner* — Jeanette E Chapman
*Assistant Examiner* — James Buckle, Jr.
(74) *Attorney, Agent, or Firm* — Doherty, Wallace, Pillsbury & Murphy, P.C.

(57) ABSTRACT

A structural support device comprising a receiver which is configured to receive and to connect a framed structure, a weight bearing member to which the receiver is attached, and a vertical support member which is attached to the weight bearing member and which may be capable of adjusting the overall height of the structural support device. The structural support device may further comprise a footing which assists in securing the structural support device to the ground and/or to a ground support.

24 Claims, 14 Drawing Sheets

STRUCTURAL SUPPORT DEVICE

CROSS REFERENCE TO RELATED APPLICATIONS

This application claims the benefit of U.S. Provisional Application No. 61/539,534 filed on Sep. 27, 2011.

BACKGROUND OF THE INVENTION

1. Field of the Invention

The invention relates to a structural support device. More particularly, the invention relates to a structural support device useful in the elevation, and support of framed structures while providing connections for the framed members, wherein exemplary framed members include, for example, stages, platforms, decks, sheds, porches, houses, cabins, and the like.

2. Background of the Invention

Raised framed structures are traditionally built upon a frame containing two or more horizontally extending members. Support systems for these framed structures typically include concrete posts, blocks, piers, and the like which are cumbersome, slow to build, and are intended for permanent installation. Furthermore, these types of supports are disruptive to the immediately underlying terrain.

Accordingly, what is needed is a structural support device that can support a framed structure adequately while providing connections for the structure itself, wherein such structural support device has the added advantages of quick and easy assembly an disassembly, wherein such assembly does not cause undue disruption to the immediately underlying terrain, and which can occur on uneven terrain to create a level-placed framed structure.

BRIEF SUMMARY OF THE INVENTION

The above-discussed problems are greatly reduced or alleviated by a structural support device comprising a receiver which is configured to receive and connect a framed structure, a weight bearing member to which the receiver is attached, and a vertical support member which is attached to the weight bearing member and which is capable of adjusting the overall height of the structural support device. The structural support device may further comprise a footing which assists in securing the structural support device to, e.g., the ground and/or ground support.

In an exemplary embodiment, the structural support device comprises a vertical support member comprising a body, wherein the body comprises a top side opposite to a bottom side and joined thereto by a side wall; a weight bearing member having a body comprising a top side opposite to a bottom side, wherein the bottom side is directed towards the top side of the body of the vertical support member; and a receiver comprising a first body which bends along a longitudinal axis thereof to from a first plate and a second plate, wherein each of the first plate and the second plate of the first body comprises a top side opposite to a bottom side and a front side opposite to a back side, wherein the bottom sides of the first plate and the second plate of the first body are directed towards the top side of the body of the weight bearing member.

In an exemplary embodiment, the structural support device may further comprise a post comprising a top side opposite to a bottom side and joined thereto by a side wall, wherein the bottom side of the post is directed towards the top side of the body of the weight bearing member, and the side wall of the post is directed towards the back sides of the first plate and the second plate of the first body of the receiver.

In an exemplary embodiment, the bottom side of the body of the vertical support member may lead into a channel formed within the body of the vertical support member, wherein the vertical support member further comprises an interior body having a top side joined to a bottom side by a side wall, wherein the top side of the interior body is disposed within the channel.

In an exemplary embodiment, the receiver may further comprise a second body, wherein the second body bends along a longitudinal axis thereof to form a first plate and a second plate, wherein each of the first plate and the second plate of the second body comprises a top side opposite to a bottom side and a front side opposite to a back side wherein the bottom sides of the first plate and the second plate of the second body are directed towards the top side of the body of the weight bearing member.

In an exemplary embodiment, a structural support device may comprise a weight bearing member comprising a plate having a top side opposite to a bottom side, and a first lateral edge adjacent to a second lateral edge; a wheel joined to the bottom side of the plate of the weight bearing member; and a receiver comprising a body wherein the body bends along a longitudinal axis thereof to form a first plate and a second plate, wherein each of the first plate and the second plate comprises a top side opposite to a bottom side and a front side opposite to a back side.

In an exemplary embodiment, a structural support device may comprise a vertical support member comprising a body, wherein the body comprises a top side joined to a bottom side by a side wall; and a receiver comprising a body which bends along a longitudinal axis thereof to form a first plate and a second plate, wherein each of the first plate and the second plate of the body comprises a top side opposite to a bottom side and a front side opposite to a back side, wherein the back side of the first plate is directed towards the side wall of the vertical support member.

In an exemplary embodiment, a structural support device may comprise a vertical support member comprising a top side joined to a bottom side by a side wall; a flange which extends from the top side of the vertical support member, wherein the flange bends along a longitudinal axis thereof to form a first plate and a second plate, wherein each of the first and second plates of the flange comprises a front side opposite to a back side; and a reinforcement member comprising a body having a bend along a longitudinal axis thereof, wherein the bend forms a first plate contiguous with a second plate, wherein the first plate of the body of the reinforcement member is directed towards the first plate of the flange; and the second plate of the body of the reinforcement member is directed towards the second plate of the flange.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
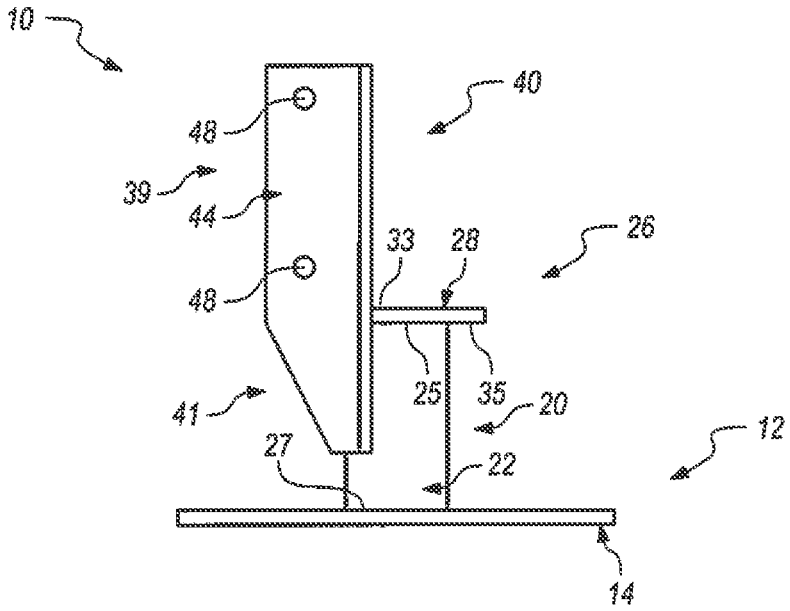
FIGS. 1-3 are schematics depicting an exemplary structural support device.

Disclosed herein is a structural support device useful in the elevation and support of framed structures, while providing connections for the framed members, wherein exemplary framed structures include without limitation, platforms, decks, sheds, porches, houses, cabins, and the like. The structural support device is configured to have several advantages over currently known structural support devices, wherein such advantages include, for example, relatively easy and quick assembly and disassembly, ready transportability, the ability to accommodate uneven, i.e., varying sloped, terrain, the ability to assemble and use the device with minimal impact to the immediately underlying terrain, and the like.

To meet these ends, in an exemplary embodiment, the structural support device comprises a weight bearing member disposed between a vertical support member and a receiver. In an exemplary embodiment, the vertical support member comprises means whereby the length of the vertical support member may be adjusted thereby allowing for variability of the height of the device. This feature is particularly advantageous where the structural support device is being used on uneven terrain. For instance, one portion of the terrain may be lower in height than another portion of the terrain. To ensure level placement of the framed structure, at least two structural support devices may be used in combination with each other, and the vertical support members may be vertically adjusted relative to each other via, e.g., a telescoping mechanism, until the level placement of the framed structure is ensured.

The vertical support member may be used in combination with a lug so as to hold or maintain the vertical support member in, for example, a concrete footing, a sonotube, and the like. Accordingly, a bottom side of the vertical support member may receive and/or otherwise secure a lug thereto such that the vertical support member may be secured to, e.g., the concrete footing, sonotube, and the like.

The weight bearing member provides a means whereby the weight of the framed structure may be distributed evenly thereon, thereby lessening the deformation of the framing member.

The receiver is configured and dimensioned to receive, hold, and connect at least a portion of the framed structure, wherein such portion of the framed structure may be formed of e.g., steel, wood, plastic, and the like. Accordingly, the receiver is geometrically configured in a fashion that will best accommodate the framed structure's geometrical configuration, wherein such configurations of the framed structure may include, for example, a right angle corner, a T-junction, a straight run support, and the like. Additionally, in an exemplary embodiment, the receiver may be sized and shaped so as to support, e.g., a vertical post, column, and the like, which extends upward from the structural support device in a direction opposite from the ground. Accordingly, in this embodiment, the receiver may be configured as a sleeve to hold and support, e.g., a vertically extending post, column, and the like.

In an exemplary embodiment, the structural support device further comprises a footing upon which the vertical support member may be disposed and to which the vertical support member may be secured. Ideally, the footing is configured and dimensioned to receive and to distribute the weight of the structural support device and of the framed structure over a relatively large surface area. To that end, the footing may comprise a wide variety of materials, wherein an exemplary material includes, for example, steel. Additionally, the footing may comprise a plate having a plurality of holes formed therethrough, in combination with which fastening members, such as nails, screws, and the like, may be used to further secure the structural support device to the underlying terrain and/or to an artificial ground support such as, for example, concrete, stone, pavement, and the like.

The structural support device further may comprise a brace which may be disposed diagonally between and connected to the vertical support member and to the framed structure. The brace is particularly beneficial where the foundation of the framed structure is raised more than about 18 inches from the ground and/or ground support as the brace provides further structural support in this situation.

To ease the motion of the structural support device and/or the framed structure, the structural support device may further comprise one or more motion facilitators which may include, for example a wheel, a castor, a skid (such as, for example, a ski), and the like. In an exemplary embodiment, the motion facilitator may be attached to the footing, or in the event a footing is not used, the motion facilitator may be attached to the vertical support member. In an exemplary embodiment, the motion facilitator is removable from the structural support device.

The structural support device may further comprise one or more tie down straps useful in securing the framed structure to the ground and/or to the ground support. To accommodate the one or more tie down straps, one or more of the vertical support member, the weight bearing member, the receiver, and, when used, the footing, may comprise one or more attachment members which are configured to engage with the one or more tie down straps, wherein an exemplary attachment member includes, for example, an eyelet, a hole, and the like.

The invention will further be described with reference to the drawings. While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
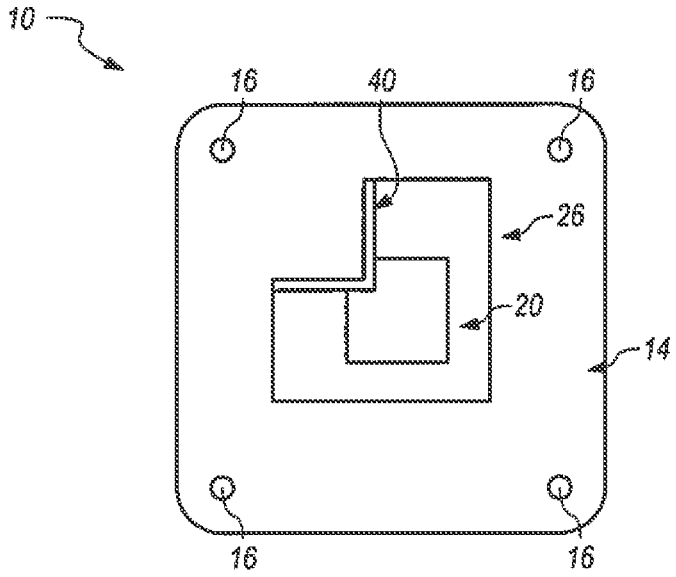
Figure 3:
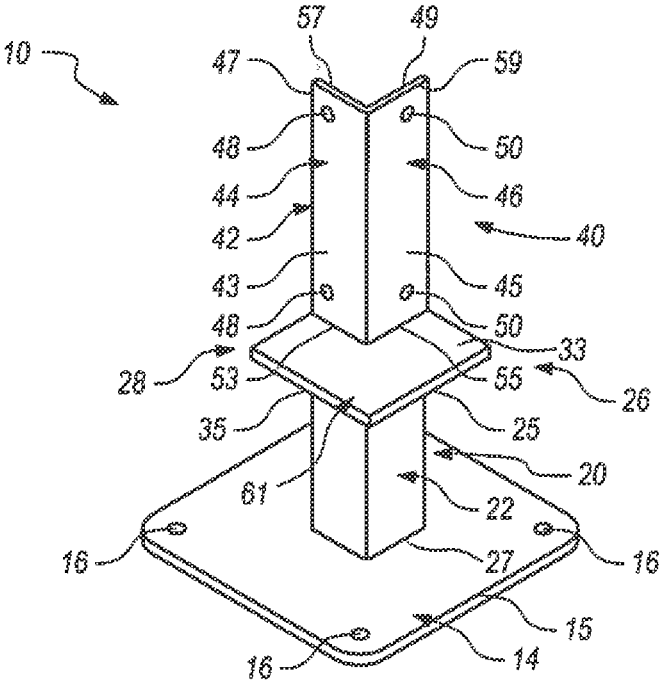

Referring to FIGS. 1-3, an exemplary structural support device 10 comprises a footing 12 comprising a plate 14 having a hole 16 formed therethrough near each of the corners thereof. Vertically extending from and centrally disposed on plate 14 is a vertical support member 20. Vertical support member 20 comprises a substantially columnar-shaped exterior body 22, wherein body 22 is partly defined by a top side 25 opposite to a bottom side 27, wherein bottom side 27 is disposed on a top side 15 of plate 14.

Centrally disposed atop vertical support member 20 is a weight bearing member 26. Weight bearing member 26 comprises a body 28 having a top side 33 opposite to a bottom side 35. Bottom side 35 is disposed on top side 25 of exterior body 22 such that body 28 overhangs exterior body 22 of vertical support member 20.

Structural support member 10 further comprises a receiver 40, a posterior portion 41 of which is disposed against exterior body 22 of vertical support member 20 to provide additional support structural support device 10, and an anterior portion 39 of which is disposed on body 28 of weight bearing member 26. Anterior portion 39 bends along a length thereof to form a plate 44 and a plate 46. Each of plates 44 and 46 respectively comprises a front side 43 and 45 opposite to a back side 47 and 49, and a respective bottom side 53 and 55 opposite to a respective top side 57 and 59. Bottom sides 53 and 55 of plates 44 and 46 are disposed on top side 33 of weight bearing member 26 to create a right angled surface 61 on top side 33 of weight bearing member 26. Additionally, each of plates 44 and 46 has a respective plurality of holes 48 and 50 formed therethrough for purposes of securing a framed structure thereto and/or for securing parts of the structure to itself.

Figure 4:
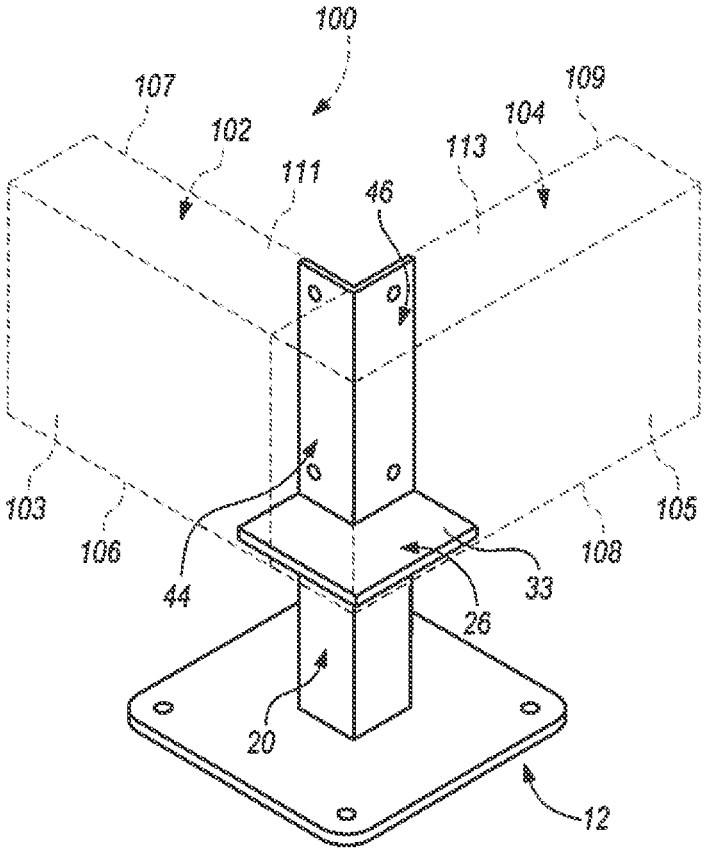
FIG. 4 is a schematic depicting an exemplary assembly comprising the structural support device depicted in FIGS. 1-3 and an exemplary framed structure.

FIG. 4 depicts an exemplary application of structural support device 10 to an exemplary framed structure 100, wherein such application is particularly well suited for securement of an L-shaped beam. Structure 100 comprises a beam 102 opposite to a beam 104. Each of beam 102 and beam 104 respectively comprises a front side 103 and 105 opposite to a back side 107 and 109, and a top side 111 and 113 opposite to a bottom side 106 and 108.

Back side 107 of beam 102 is disposed against front side 43 of plate 44 while back side 109 of beam 104 is disposed against front side 45 of plate 46. Respective bottom sides 106 and 108 of beams 102 and 104 are disposed on top side 33 of body 28 of weight bearing member 26. Beams 102 and 104 may be secured further to structural support device 10 through the use of, e.g., bolts (not shown) which may be inserted through respective holes 48 and 50 of receiver 40 and driven through beams 102 and 104.

Figure 5:
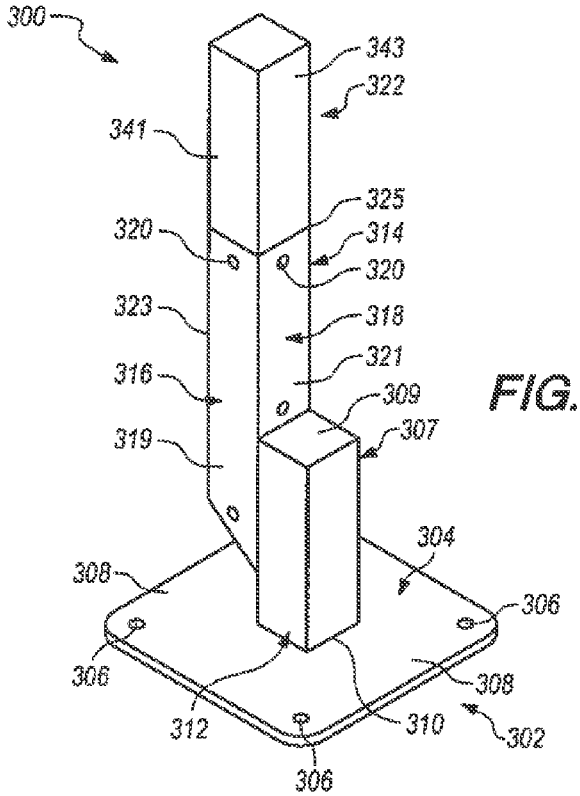
FIG. 5 is a schematic depicting an exemplary structural support device.

Referring to FIG. 5, another exemplary structural support device 300 comprises a footing 302 comprising a plate 304 having a hole 306 formed therethrough near each of the corners thereof for purposes of securing footing 302 to, e.g., the ground and/or ground support. Centrally disposed on a top side 308 of plate 304 is a vertical support member 307. Vertical support member 307 comprises a top side 309 oppositely joined to a bottom side 310 by a side wall 312.

Structural support device 300 further comprises a receiver 314. Receiver 314 bends along a longitudinal axis to form a plate 316 and a plate 318. Each of plates 316 and 318 respectively comprises a front side 319 and 321 opposite to a back side 323 and 325, wherein holes 320 are formed through front side 319 and back side 323 and through front side 321 and back side 325. A posterior portion (not shown) of front side 321 is disposed on side wall 312 of vertical support member 307 such that plates 316 and 318 extend in a direction opposite to footing 302.

Structural support device 300 further comprises a post 322 having a side wall 341 contiguously attached to a side wall 343. Side walls 341 and 343 are respectively disposed against back sides 323 and 325 of receiver 314 and may be secured thereto by inserting lugs within holes 320 of plates 316 and 318 and bearing such lugs through respective side walls 341 and 343.

Figure 6:
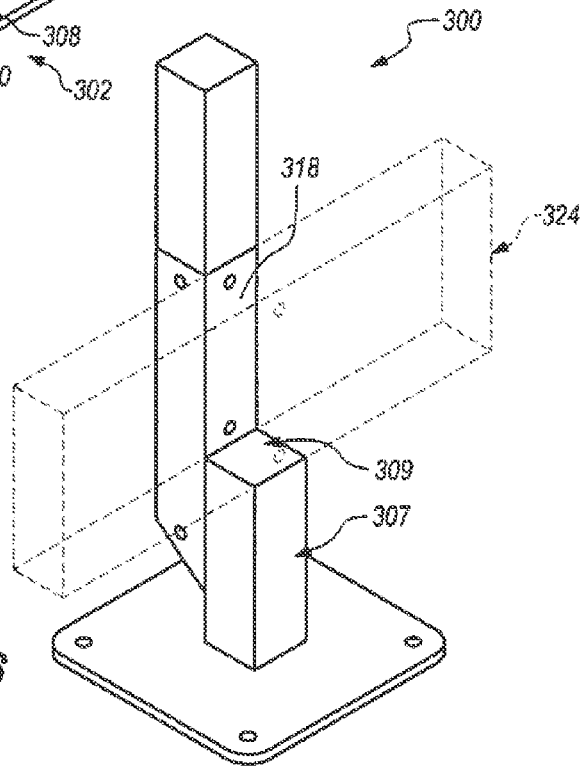
FIG. 6 is a schematic depicting an exemplary assembly comprising the structural support device depicted in FIG. 5 in association with an exemplary framed structure.

The structural support device 300 is particularly well adapted for use with a straight line connection with a framed structure such, as for example, as is shown in FIG. 6. More specifically, FIG. 6 depicts an exemplary assembly comprising structural support device 300 in combination with a framed structure comprising a beam 324. Here, beam 324 is disposed on top side 309 of vertical support member 307 and against front side 321 of plate 318.

Beam 324 comprises a front side 350 opposite to a back side 352, and a top side 354 opposite to a bottom side 356. Beam 354 further comprises a plurality of holes 358 formed through front side 350 and back side 352. Bottom side 356 abuts top side 309 of vertical support member 307 while back side 352 of beam 325 rests against front side 321 of plate 318. Plurality of holes 358 is aligned with plurality of holes 327. One or more lugs may be inserted through plurality of holes 358 to secure beam 324 to device 300. Bottom side 356 abuts top side 309 of vertical support member 307.

Figure 7:
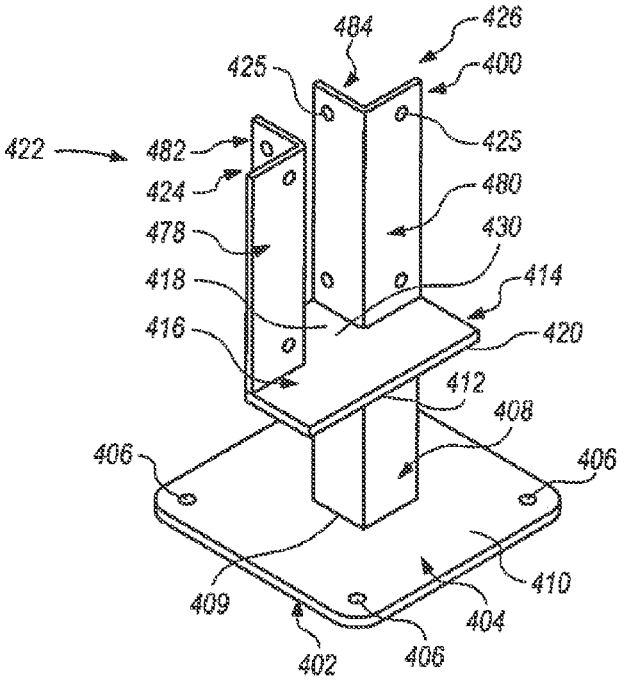
FIG. 7 is a schematic depicting an exemplary structural support device.

Another exemplary structural support device 400 is depicted in FIG. 7. Here, structural support device 400 comprises a footing 402 comprising a plate 404 having a hole 406 formed near each of the corners thereof for purposes of securing device 400 to, e.g., the ground and/or ground support. Structural support device 400 further comprises a vertical support member 408 having a bottom side 409 that is centrally disposed on a top side 410 of plate 404. Disposed on a top side 412 of vertical support member 408, opposite to bottom side 409, is a weight bearing member 414 comprising a plate 416 having a top side 418 opposite to a bottom side 420, wherein bottom side 420 is disposed on top side 412 of vertical support member 408.

Structural support device 400 further comprises a receiver 422 comprising a body 424 and a body 426. Each of body 424 and body 426 bends along a longitudinal axis thereof to form a respective plate 478 and 480 and a respective plate 482 and 484. Together, plate 478 and plate 482 comprises a bottom side 421 which is disposed on top side 418 of plate 416 of weight bearing member 414, while, together, plate 480 and plate 484 comprises a bottom side 423 which is disposed on top side 418. Such positioning of bodies 424 and 426 creates a T-shaped area on top side 418. The T-shaped area comprises a channel 430 between bodies 424 and 426 and a portion 432 intersected by channel 430. Plate 478, plate 482, plate 480, and plate 484 comprise holes 425 formed therethrough for purposes of securing framed structures thereto.

Figure 8:
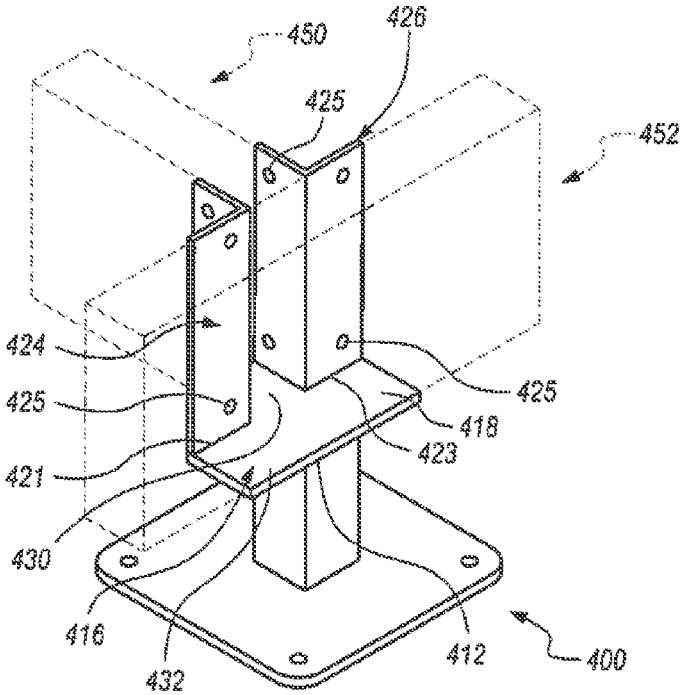
FIG. 8 is a schematic depicting an exemplary assembly comprising the structural support device depicted in FIG. 7 in combination with an exemplary framed structure.

Structural support device 400 is particularly advantageous for purposes of supporting a T-connection between the framed structures. FIG. 8 depicts an exemplary assembly comprising structural support device 400 in combination with an exemplary framed structure comprising a beam 450 and a beam 452. Here, beam 450 is inserted through channel 430 and is secured to plates 482 and 484 by inserting lugs through holes 425 formed through plates 482 and 484 and into beam 450. Additionally, beam 452 rests against portion 432 of plate 416 and against plates 478 and 480, and may be secured to plates 478 and 480 via lugs positioned through holes 425 formed through plates 478 and 480.

Figure 9:
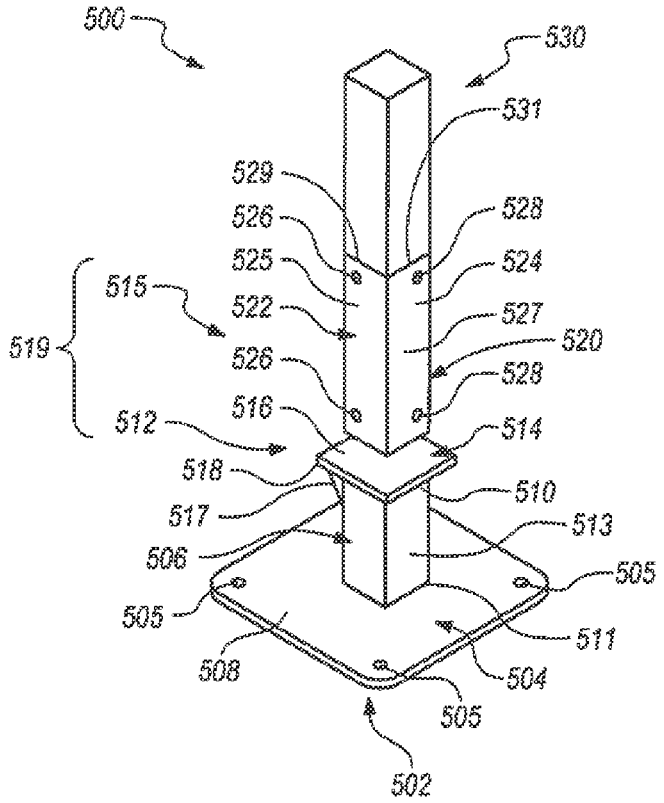
FIGS. 9 and 10 are schematics depicting an exemplary assembly comprising an exemplary embodiment of a structural support device and exemplary framed structures.

FIG. 9 depicts an exemplary structural support device 500. Here, structural support device 500 comprises a footing 502 comprising a plate 504 having a hole 505 formed in each of the corners thereof for purposes of securing device 500 to, e.g., the ground and/or ground support. Device 500 further comprises a vertical support member 506 centrally disposed on a top side 508 of plate 504. Vertical support member 506 comprises a top side 510 opposite to a bottom side 511 wherein bottom side 511 is disposed on top side 508 of plate 504 of footing 502. Vertical support member 506 further comprises a side wall 513 which joins top side 510 to bottom side 511.

Structural support device 500 further comprises a weight bearing member 512 comprising a plate 514 having a top side 516 opposite to a bottom side 518. Bottom side 518 is centrally disposed on top side 510 of vertical support member 506.

Disposed on top side 516 of plate 514 is a receiver 515. Receiver 515 comprises a posterior portion 517 and an anterior portion 519. Posterior portion 517 is disposed on side wall 513 of vertical support member 506. Anterior portion 519 comprises a body 520. Body 520 bends along a longitudinal axis thereof to form a plate 522 and a plate 524. Plates 522 and 524 are disposed on top side 516 to form an L-shaped region directly abutting front sides 525 and 527 of respective plates 522 and 524. Each of plates 522 and 524 respectively comprises holes 526 and 528 formed therethrough. Device 500 further comprises a vertical post 530 which is received by and secured to back sides 529 and 531 of respective plates 522 and 524.

Figure 10:
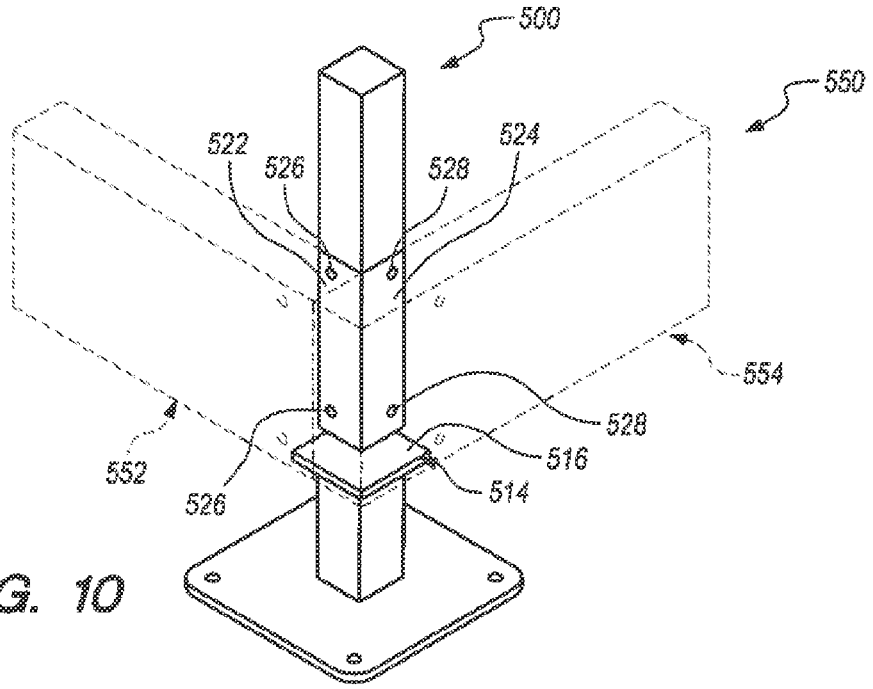

FIG. 10 depicts an assembly comprising structural support device 500 and an L-shaped framing member 550 comprising a beam 552 and a beam 554. Here, each of beams 552 and 554 is disposed on top side 516 of weight bearing member 512 and against front sides 525 and 527 of plates 522 and 524, and is respectively secured thereto via lugs positioned through holes 526 and 528 and beams 552 and 554.

Figure 11:
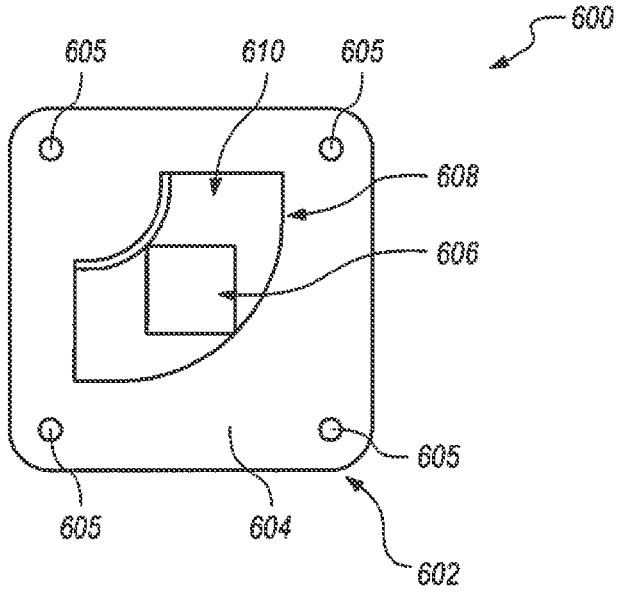
FIG. 11 is a schematic depicting an exemplary structural support device.

FIG. 11 depicts an exemplary structural support device 600. Here structural support device 600 comprises a footing 602 comprising a plate 604 having a hole 605 formed near each of the corners thereof. Device 600 further comprises a vertical extension member (not shown), a weight bearing member 606, and a receiver 608. Receiver 608 comprises a curve-shaped body 610. Device 600 is particularly useful for purposes of securing variably-angled framed structures.

Figure 12:
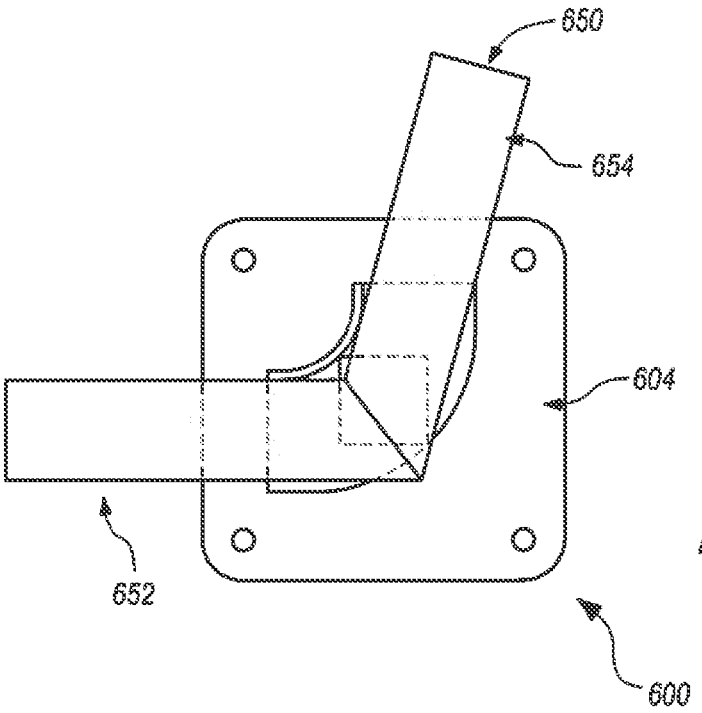
FIG. 12 is a schematic depicting an exemplary assembly comprising the structural support device depicted in FIG. 11 in combination with an exemplary framed structure.

FIG. 12 depicts an assembly comprising structural support device 600 in combination with a variably-angled framed structure 650. Variably-angled framed structure 650 comprises a beam 652 and a beam 654, wherein each of beams 652 and 654 are attached and secured to receiver 608.

Figure 13:
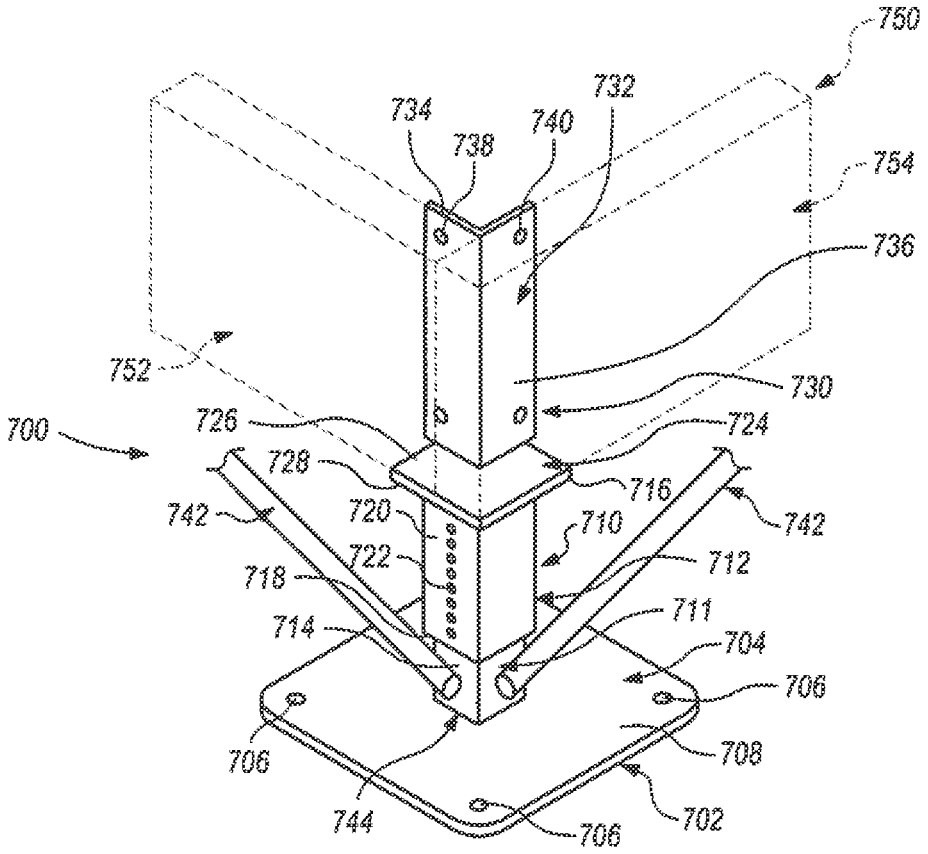
FIG. 13 is a schematic depicting an exemplary assembly comprising an exemplary structural support device in combination with an exemplary framed structure.

FIG. 13 depicts an exemplary structural support device 700 comprising a footing 702 comprising a plate 704 having a hole 706 formed near all of the corners thereof. Disposed on a top side 708 of plate 704 is a vertical support member 710.

Vertical support member 710 comprises a telescoping means wherein the length of vertical support member 710 may be adjusted. To that end, vertical support member 710 comprises an interior body 711 disposed within a channel (not shown) formed within an exterior body 712, wherein interior body 711 is fixed to top side 708 of plate 704. Interior body 711 comprises a detent (not shown) disposed on a side wall 714 thereof. Exterior body 712 comprises a top side 716 joined to a bottom side 718 by a side wall 720. Side wall 720 comprises a series of holes 722 formed along a length thereof. The length of vertical support member 710 may be adjusted by engaging detent 714 to any one of the holes of series of holes 722.

Centrally disposed on top side 716 of vertical support member 710 is a weight bearing member 724 having a top side 726 opposite to a bottom side 728. Disposed on top side 726 is a receiver 730 comprising a body 732 which bends to form a plate 734 and a plate 736. Each of plates 734 and 736 respectively comprises holes 738 and 740 for purposes of securing a framed structure 750 thereto. Structural support device 700 further comprises a pair of braces 742 secured to a bottom portion 744 of interior body 711.

Framed structure 750, which is ideally suited for use in combination with vertical support member 710, comprises a beam 752 and a beam 754. Beam 752 rests against top side 726 of weight bearing member 724 and against plate 734, while beam 754 rests against top side 726 of weight bearing member 724 and against plate 736.

Figure 14:
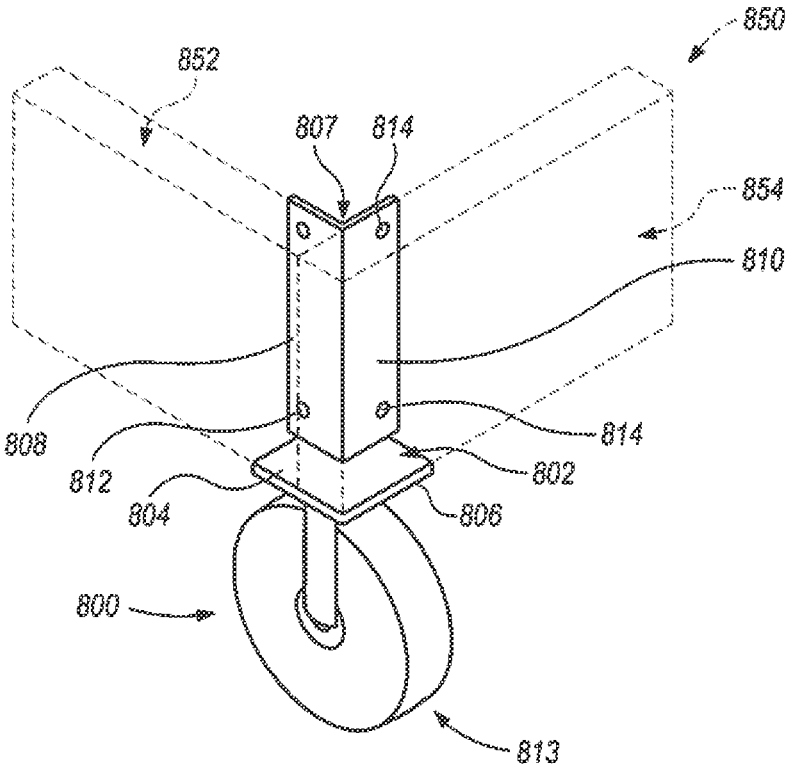
FIG. 14 is a schematic depicting an exemplary assembly comprising an exemplary structural support device in combination with an exemplary framed member.
Figure 15:
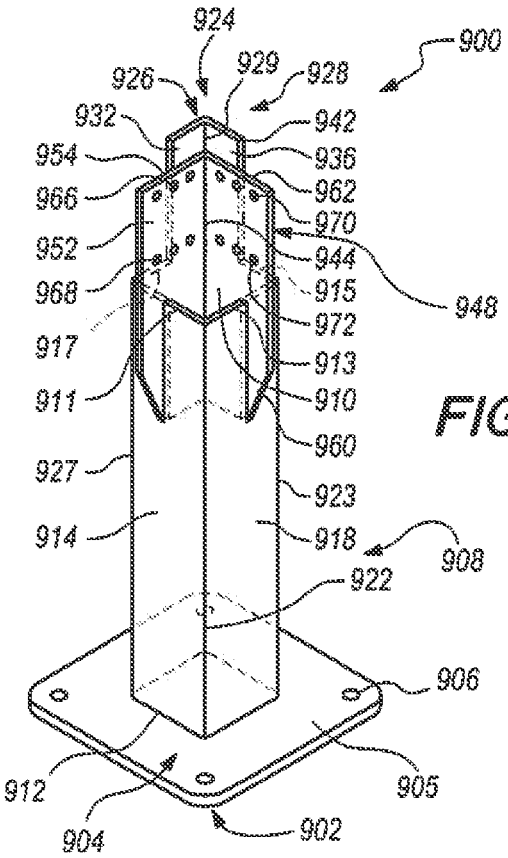
FIG. 15 is a schematic depicting a front-side view of an exemplary structural support device.
Figure 16:
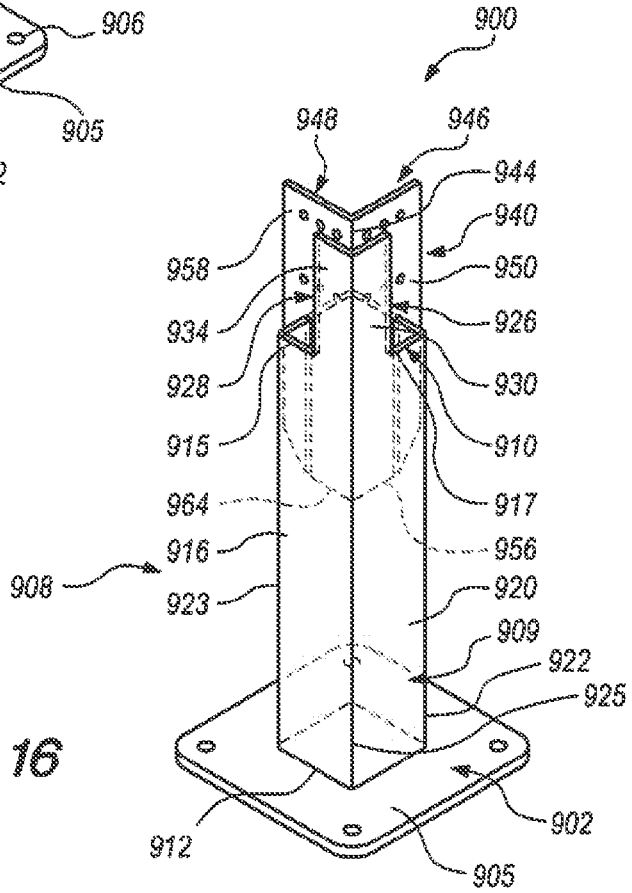
FIG. 16 is a schematic depicting a rear-side view of the structural support device depicted in FIG. 15.
Figure 19:
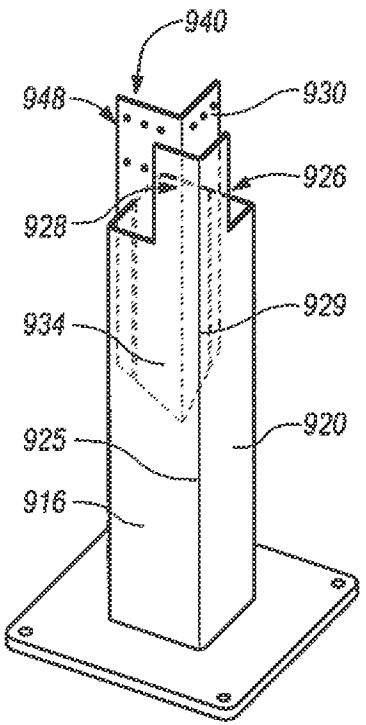
FIGS. 17-19 are three-dimensional images of the structural support device depicted in FIGS. 15 and 16.
Figure 18:
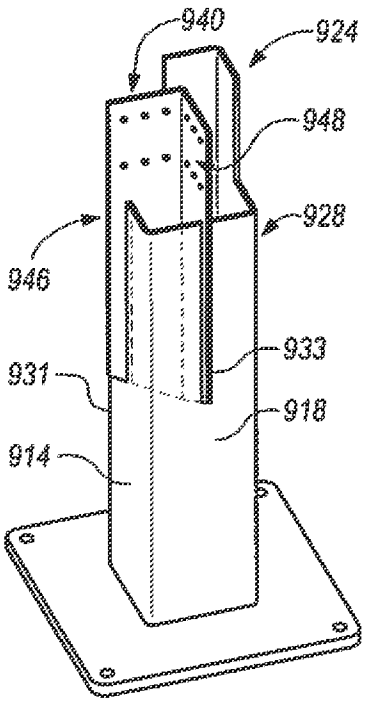
Figure 17:
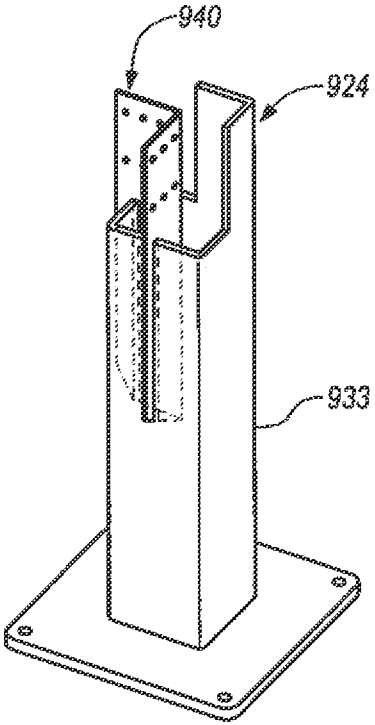

FIG. 14 depicts an exemplary structural support device 800 comprising a weight bearing member 802 having a top side 804 opposite to a bottom side 806. Affixed to top side 804 is a body 807 which bends along a longitudinal axis thereof to form a plate 808 joined to a plate 810. Each of plates 808 and 810 respectively comprises holes 812 and 814 formed therethrough for purposes of securing a framed structure thereto. Device 800 further comprises a wheel 813 attached to bottom side 806 of weight bearing member 802. A framed structure 850 is also depicted in FIG. 14 as comprising a beam 852 perpendicularly attached to a beam 854, wherein beam 852 rests against top side 804 of weight bearing member 802 and against plate 808, while beam 854 rests against top side 804 of weight bearing member 802 and against plate 810.

FIGS. 15-19 depict another exemplary structural support device which is particularly well-suited for use with a beam comprising steel. Referring to FIGS. 15-19, a structural support device 900 comprises a footing 902 comprising a plate 904 having a hole 906 formed therethrough near each of the corners thereof.

Vertically extending from and centrally disposed on plate 904 is a vertical support member 908 having a substantially columnar shaped body 909. Body 909 comprises an open-ended top side 910 opposite to a bottom side 912, wherein bottom side 912 is disposed on a top side 905 of plate 904. Top side 910 comprises top edges 911, 913, 915, and 917. Body 909 further comprises a lateral wall 914 which extends from top edge 911 to bottom side 912, a lateral wall 918 which extends from top edge 913 to bottom side 912, a lateral wall 916 which extends from top edge 915 to bottom side 912, and a lateral wall 920 which extends from top edge 917 to bottom side 912. Lateral wall 914 joins lateral wall 918 at a spine 922, lateral wall 918 meets lateral wall 916 at a spine 923, lateral wall 916 meets lateral wall 920 at a spine 925, and lateral wall 920 meets lateral wall 914 at a spine 927.

Lateral walls 914 and 918 each comprises a respective slot 931 and 933 formed therein. Each of slots 931 and 933 extends about 180 degrees from respective top sides 911 and 913 to an approximate mid-point of respective lateral walls 914 and 918.

Flange 924 comprises a plate 926 which extends from an approximate mid-point of top edge 917, and a plate 928 which extends from an approximate mid-point of top edge 915, wherein plates 926 and 928 meet one another at a spine 929, wherein spine 929 is co-linear with spine 925. Plate 926 comprises a front side 930 opposite to a back side 932; and plate 928 comprises a front side 934 opposite to a back side 936.

Structural support device 900 further comprises a reinforcement member 940. Reinforcement member 940 comprises a body 942 which bends at a spine 944 to form a plate 946 and a plate 948. Plate 946 comprises a front side 950 opposite to a back side 952, and a top side 954 opposite to a bottom side 956. Plate 946 is disposed within slot 931 of lateral wall 914 such that front side 950 is directed towards back side 932 of plate 926 of flange 924. Plate 946 further comprises a series of holes 966 and a series of holes 968 formed through front side 950 and back side 952. Plate 948 comprises a front side 958 opposite to a back side 960 and a top side 962 opposite to a bottom side 964. Plate 948 is disposed within slot 933 of lateral wall 918 such that front side 958 is directed towards back side 936 of plate 928 of flange 924. Plate 948 further comprises a series of holes 970 and a series of holes 972 formed through front sides 958 and 960.

Figure 20:
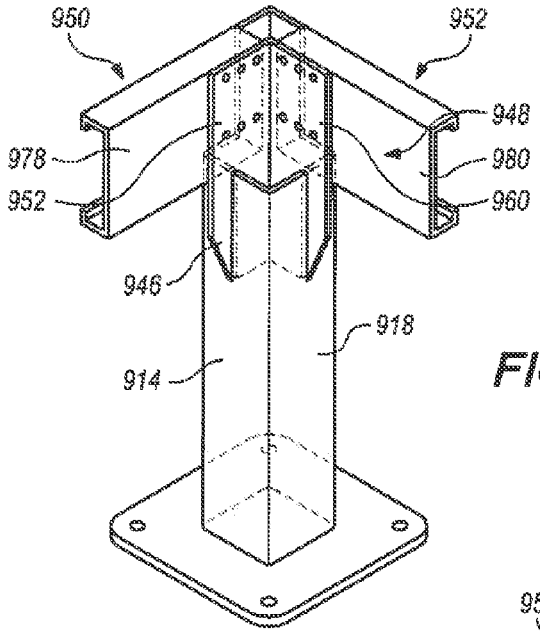
FIG. 20 is a schematic depicting a front-side view of an exemplary assembly comprising the structural support device depicted in FIG. 15-19.
Figure 21:
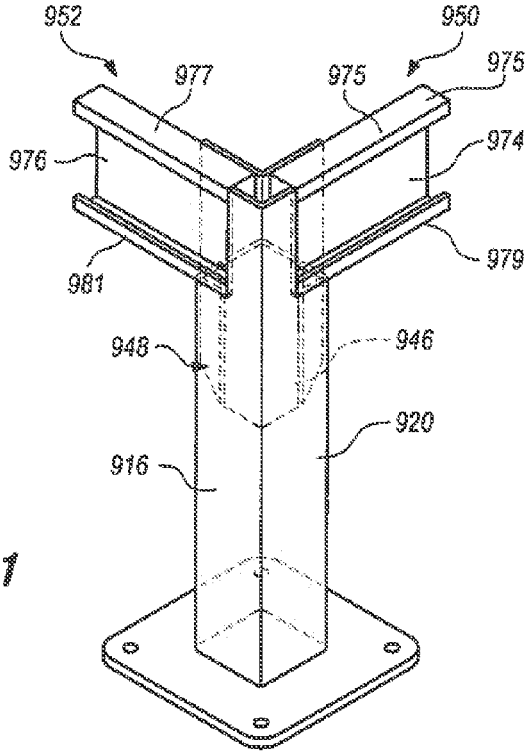
FIG. 21 is a schematic depicting a rear-side view of the assembly depicted in FIG. 20.
Figure 22:
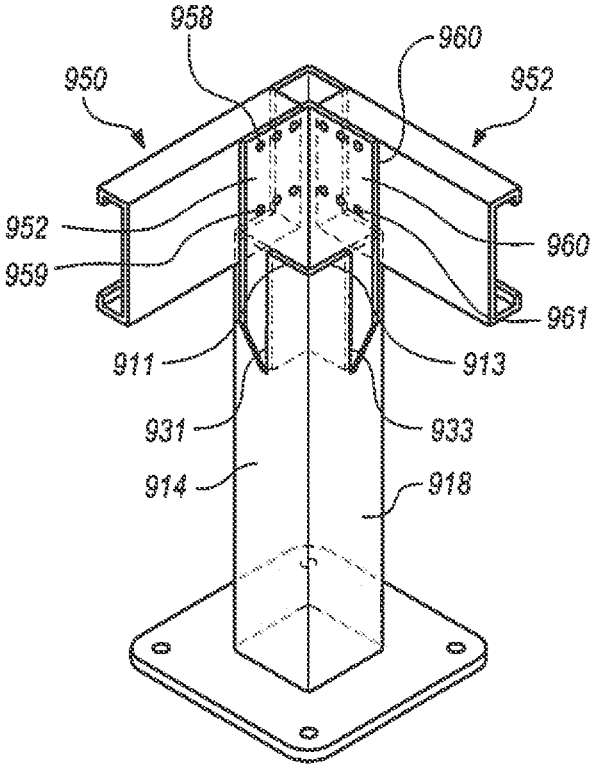
FIG. 22 is a three-dimensional image of the assembly depicted in FIGS. 20 and 21.

FIGS. 20-22 depict an exemplary assembly comprising structural support device 900 in combination with a beam 950 and a beam 952, wherein, in an exemplary embodiment, beams 950 and 952 comprise steel. As shown in FIGS. 20-22, each of beams 950 and 952 respectively comprises front sides 974 and 976 opposite to back sides 978 and 980, and top sides 975 and 977 opposite to bottom sides 979 and 981. Each of beams 950 and 952 further respectively comprises a series of holes 958 and 959 and a series of holes 960 and 961 formed through respective front sides 954 and 956 and through respective back sides 958 and 960.

Beams 950 and 952 are positioned relative to structural support device 900 such that beams 950 and 952 are disposed between flange 924 and reinforcement member 940. More particularly, back side 978 of beam 950 is disposed on front side 950 of plate 946 of reinforcement member 940 such that series of holes 966 is aligned with series of holes 958 and series of holes 968 is aligned with series of holes 960. Back side 960 of beam 952 is disposed on front side 976 of plate 948 of reinforcement member 940 such that series of holes 970 is aligned with series of holes 959 of beam 952 and series of holes 972 is aligned with series of holes 961 of beam 952. A lug may be positioned within one or more of the holes from the various series of holes to secure respective beams 950 and 952 to reinforcement member 940.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An assembly comprising:

a vertical support member comprising a body, wherein the body comprises a top side opposite to a bottom side and joined thereto by a side wall;

a weight bearing member having a body comprising a top side opposite to a bottom side, wherein the bottom side is directed towards the top side of the body of the vertical support member;

a receiver comprising a first body which bends along a longitudinal axis thereof to from a first plate and a second plate, wherein each of the first plate and the second plate of the first body comprises a top side opposite to a bottom side and a front side opposite to a back side, wherein the bottom sides of the first plate and the second plate of the first body are directed towards the top side of the body of the weight bearing member; and a first beam and a second beam, wherein each of the first beam and the second beam comprises a top side opposite to a bottom side, and a front side opposite to a back side, wherein the back side of the first beam is disposed on the front side of the first plate of the first body, the back side of the second beam is disposed on the front side of the second plate of the first body, and the bottom sides of the first beam and the second beam are disposed on the top side of the body of the weight bearing member.

2. The assembly of claim 1, wherein the first beam and the second beam are components of a framed structure, wherein the framed structure is selected from the group consisting of a platform, a deck, a shed, a porch, a house, and a cabin.

3. The assembly of claim 1, wherein the structural support device further comprises a footing comprising a plate having a top side opposite to a bottom side, wherein the bottom side of the vertical support member is disposed on the top side of the plate of the footing.

4. An assembly comprising:

a vertical support member comprising a body, wherein the body comprises a top side opposite to a bottom side and joined thereto by a side wall;

a weight bearing member having a body comprising a top side opposite to a bottom side, wherein the bottom side is directed towards the top side of the body of the vertical support member; and a receiver comprising a first body which bends along a longitudinal axis thereof to from a first plate and a second plate, wherein each of the first plate and the second plate of the first body comprises a top side opposite to a bottom side and a front side opposite to a back side, wherein the bottom sides of the first plate and the second plate of the first body are directed towards the top side of the body of the weight bearing member, and wherein the first body of the receiver further comprises a posterior portion which extends from the first plate and the second plate wherein the posterior portion is disposed on the side wall of the vertical support member.

5. The assembly of claim 4, further comprising a first beam and a second beam, wherein each of the first beam and the second beam comprises a top side opposite to a bottom side, and a front side opposite to a back side, wherein the back side of the first beam is disposed on the front side of the first plate of the first body, the back side of the second beam is disposed on the front side of the second plate of the first body, and the bottom sides of the first beam and the second beam are disposed on the top side of the body of the weight bearing member.

6. The assembly of claim 4, further comprising a post comprising a top side opposite to a bottom side and joined thereto by a side wall, wherein the bottom side of the post is directed towards the top side of the body of the weight bearing member, and the side wall of the post is directed towards the back sides of the first plate and the second plate of the first body of the receiver.

7. The assembly of claim 6, further comprising a first beam and a second beam, wherein each of the first beam and the second beam comprises a top side opposite to a bottom side, and a front side opposite to a back side, wherein the back side of the first beam is disposed on the front side of the first plate of the first body, the back side of the second beam is disposed on the front side of the second plate of the first body, and the bottom sides of the first beam and the second beam are disposed on the top side of the body of the weight bearing member.

8. An assembly comprising:

a vertical support member comprising a body, wherein the body comprises a top side opposite to a bottom side and joined thereto by a side wall;

a weight bearing member having a body comprising a top side opposite to a bottom side, wherein the bottom side is directed towards the top side of the body of the vertical support member; and a receiver comprising a first body which bends alone a longitudinal axis thereof to from a first plate and a second plate, wherein each of the first plate and the second plate of the first body comprises a top side opposite to a bottom side and a front side opposite to a back side, wherein the bottom sides of the first plate and the second plate of the first body are directed towards the top side of the body of the weight bearing member;

wherein the bottom side of the body of the vertical support member leads into a channel formed within the body of the vertical support member, and wherein the vertical support member further comprises an interior body having a top side joined to a bottom side by a side wall, wherein the top side of the interior body is disposed within the channel.

9. The assembly of claim 8, wherein the body of the vertical support member and the interior body are slidably engaged with one another.

10. The assembly of claim 9, wherein the side wall of the body of the vertical support member comprises a plurality of holes, and wherein the side wall of the interior body of the vertical support member comprises a detent, wherein the detent engages with the plurality of holes to thereby adjust a position of the body of the vertical support member relative to the interior body.

11. The assembly of claim 9, further comprising a framed structure comprising a first beam and a second beam, wherein each of the first beam and the second beam comprises a top side opposite to a bottom side, and a front side opposite to a back side, wherein the back side of the first beam is disposed on the front side of the first plate of the first body, the back side of the second beam is disposed on the front side of the second plate of the first body, and the bottom sides of the first beam and the second beam are disposed on the top side of the body of the weight bearing member.

12. The assembly of claim 11, further comprising a first brace and a second brace, wherein each of the first brace and the second brace comprises a first terminal end opposite to a second terminal end, wherein the first terminal end of each of the first brace and the second brace is fixed to the interior body of the vertical support member and the second terminal end of each of the first brace and the second brace is attached to the framed structure.

13. An assembly comprising:

a vertical support member comprising a body, wherein the body comprises a top side opposite to a bottom side and joined thereto by a side wall;

a weight bearing member having a body comprising a top side opposite to a bottom side, wherein the bottom side is directed towards the top side of the body of the vertical support member; and a receiver comprising:

a first body which bends along a longitudinal axis thereof to from a first plate and a second plate, wherein each of the first plate and the second plate of the first body comprises a top side opposite to a bottom side and a front side opposite to a back side, wherein the bottom sides of the first plate and the second plate of the first body are directed towards the top side of the body of the weight bearing member; and a second body, wherein the second body bends along a longitudinal axis thereof to form a first plate and a second plate, wherein each of the first plate and the second plate of the second body comprises a top side opposite to a bottom side and a front side opposite to a back side wherein the bottom sides of the first plate and the second plate of the second body are directed towards the top side of the body of the weight bearing member;

wherein the bottom sides of the first plate and the second plate of the first body of the receiver and the bottom sides of the first plate and the second plate of the second body of the receiver are disposed on the top side of the body of the weight bearing member such that the front side of the first plate of the first body of the receiver is directed towards the front side of the first plate of the second body of the receiver to thereby form a channel therebetween, and such that the front side of the second plate of the first body of the receiver is co-planar with the front side of the second plate of the second body of the receiver.

14. The assembly of claim 13, further comprising a first beam and a second beam, wherein the first beam is received within the channel, and the second beam is directed towards the top side of the body of the weight bearing member and the front sides of the second plates of the first and second bodies of the receiver.

15. An assembly, comprising:

a structural support device comprising:

a weight bearing member comprising a plate having a top side opposite to a bottom side, and a first lateral edge adjacent to a second lateral edge;

a wheel joined to the bottom side of the plate of the weight bearing member; and a receiver comprising a body wherein the body bends along a longitudinal axis thereof to form a first plate and a second plate, wherein each of the first plate and the second plate comprises a top side opposite to a bottom side and a front side opposite to a back side; and a framed structure comprising a first beam and a second beam, wherein each of the first beam and the second beam comprises a top side opposite to a bottom side, and a front side opposite to a back side, wherein the back side of the first beam is directed towards the front side of the first plate, the back side of the second beam is directed towards the front side of the second plate, and the bottom sides of the first beam and the second beam are directed towards the top side of the body of the weight bearing member.

16. The assembly of claim 15, wherein the framed structure is selected from the group consisting of a platform, a deck, a shed, a porch, a house, and a cabin.

17. An assembly comprising:

a vertical support member comprising a body, wherein the body comprises a top side joined to a bottom side by a side wall;

a receiver comprising a body which bends along a longitudinal axis thereof to form a first plate and a second plate, wherein each of the first plate and the second plate of the body comprises a top side opposite to a bottom side and a front side opposite to a back side, wherein the back side of the first plate is directed towards the side wall of the vertical support member;

a framed structure, wherein the framed structure comprises a beam comprising a top side opposite to a bottom side and a front side opposite to a back side, wherein the back side of the beam is directed towards the front side of the first plate of the body and the bottom side of the beam is directed towards the top side of the vertical support member; and a post comprising a first side wall adjacent to a second side wall, wherein the first side wall is directed towards the back side of the first plate, and the second side wall is directed towards the back side of the second plate.

18. The assembly of claim 17, wherein the back side of the first plate is disposed on the side wall of the vertical support member, the first side wall of the post is disposed on the back side of the first plate, the second side wall of the post is disposed on the back side of the second plate, the back side of the beam abuts against the front side of the first plate, and the bottom side of the beam is disposed on the top side of the vertical support member.

19. An assembly comprising:

a structural support device comprising:

a vertical support member comprising a top side joined to a bottom side by a side wall;

a flange which extends from the top side of the vertical support member, wherein the flange bends along a longitudinal axis thereof to form a first plate and a second plate, wherein each of the first and second plates of the flange comprises a front side opposite to a back side; and a reinforcement member comprising a body having a bend along a longitudinal axis thereof, wherein the bend forms a first plate contiguous with a second plate, wherein:

the first plate of the body of the reinforcement member is directed towards the first plate of the flange; and the second plate of the body of the reinforcement member is directed towards the second plate of the flange;

a framed structure comprising:

a first beam disposed between the first plate of the body of the reinforcement member and the first plate of the flange; and a second beam disposed between the second plate of the body of the reinforcement member and the second plate of the flange.

20. The assembly of claim 19, wherein the side wall of the vertical support member comprises a first slot and a second slot, wherein each of the first slot and the second slot extend from the top side of the vertical support member towards the bottom side of the vertical support member, and further wherein each of the first plate and the second plate of the reinforcement member comprises a posterior end, wherein the posterior end of the first plate is fitted within the first slot and the posterior end of the second plate is fitted within the second slot.

21. The assembly of claim 20, wherein the first beam and the second beam are disposed on the top side of the vertical support member.

22. The assembly of claim 21, wherein the structural support device further comprises a footing, wherein the footing comprises a plate having a top side opposite to a bottom side, wherein the bottom side of the vertical support member is disposed on the top side of the plate of the footing.

23. The assembly of claim 21, wherein the framed structure is selected from the group consisting of a platform, a deck, a shed, a porch, a house, and a cabin.

24. The assembly of claim 21, wherein the first beam and the second beam comprise steel.

* * * * *